US008271153B2

(12) United States Patent
Kumar

(10) Patent No.: US 8,271,153 B2
(45) Date of Patent: Sep. 18, 2012

(54) SYSTEM, METHOD AND COMPUTER READABLE MEMORY MEDIUM FOR VERIFYING TRACK DATABASE INFORMATION

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 835 days.

(21) Appl. No.: 12/208,504

(22) Filed: Sep. 11, 2008

(65) Prior Publication Data

US 2010/0063657 A1 Mar. 11, 2010

(51) Int. Cl.
*G05D 1/00* (2006.01)
*H04N 7/18* (2006.01)

(52) U.S. Cl. ..... 701/19; 701/20; 348/148

(58) Field of Classification Search ..... None
See application file for complete search history.

(56) References Cited

U.S. PATENT DOCUMENTS

| | | | | |
|---|---|---|---|---|
| 5,978,718 | A | 11/1999 | Kull | |
| 6,088,635 | A | 7/2000 | Cox et al. | |
| 6,532,038 | B1 | 3/2003 | Haring et al. | |
| 2006/0129289 | A1 * | 6/2006 | Kumar et al. | 701/29 |
| 2007/0001058 | A1 * | 1/2007 | Severson | 246/1 R |
| 2007/0137514 | A1 * | 6/2007 | Kumar et al. | 105/26.05 |
| 2010/0262321 | A1 * | 10/2010 | Daum et al. | 701/20 |

* cited by examiner

*Primary Examiner* — Thomas Tarcza
*Assistant Examiner* — Nagi Murshed
(74) *Attorney, Agent, or Firm* — GE Global Patent Operation; John A. Kramer

(57) ABSTRACT

A system for verifying data in a track database comprises a track profile database stored in a memory having data relative to one or more track grades and geographic coordinates or range of coordinates associated with each of the one or more track grades. A vehicle trip plan is developed according to the track profile data that comprises a designated path of travel of the vehicle over the track system and a planned vehicle operating condition associated with each of the one or more track grades and the associated coordinates or range of coordinates of the track grades. A controller is configured to compare a stored current vehicle operating condition of the vehicle and associated geographic coordinates to the planned vehicle operating condition to verify the accuracy of the track grade data at the associated geographic coordinates.

18 Claims, 4 Drawing Sheets

SYSTEM, METHOD AND COMPUTER READABLE MEMORY MEDIUM FOR VERIFYING TRACK DATABASE INFORMATION

BACKGROUND OF THE INVENTION

Embodiments of the invention pertain to databases that are maintained and contain data relating to roadway, waterway, off-road, track and other designated pathway systems that are used for transportation by powered vehicles. More specifically, embodiments of the invention relate to databases that are maintained and contain information concerning railroad track systems.

Railroad companies operate trains and control railroad traffic on track systems that may include thousands of miles of railroad tracks. In order to control movement of trains on a track system, a track database is maintained that contains information relating to track topography, which is also referred to as the track profile data. The data stored in these databases includes, among other things, track grade data, track curvature data, and geographical coordinates of various points or segments of the track. Typically, a railroad track system is divided into geographic subdivisions, which include sets of railroad tracks extending between different train destinations. Within a subdivision, the railroad track may be segmented into track sections (that may include multiple tracks) of a predetermined length; and, for each track section there is provided one or more track grades or ranges of track grades. The track grade data for any one track section may be constant or it may have different grades in a single direction, grades in opposite directions have opposite signs, adjacent parallel tracks can have different grades or compensated grades including banking or super elevation curvature.

The geographic coordinate track data is typically provided in the form of a location of a point or section of the track and/or the identification of wayside traffic control devices or railroad crossings relative to mileposts (also referred to as "mile markers") or other reference points positioned along the track. For example, a database may show that track T5 has a 1% track grade for 10 miles (16.09 kilometers) from mile post #75 to mile post #85 at which point the grade may increase to 1.1% for the next two miles from mile post #85 to milepost #87. In another example, the database may provide that switch A1 that connects track T5 to track T6 is positioned halfway between milepost #110 and milepost #111. The database may also provide coordinate or location data at discrete points along the track, for example location data relative to a start point, ending point, mile markers, switches, signal locations, etc.

In addition, the track database may include data relative to one or more civil speed limits associated with various track sections. Sometimes the track database may have temporary speed restrictions that may be imposed as a result for example of track repairs taking place on the track.

In use, the track database for a selected track or sections of track on which a train will be traveling is provided to an operator who prepares a trip plan based on the information provided in the track database. The operator, based on past experience and/or operating manuals, maps out a train route over the track sections provided. The route will include the identity of the different tracks the train will travel on and the different speeds at which the train will travel along the track. Given the track grade, and other parameters such as train weight and length, the operator is able to determine the locomotive throttle positions necessary to achieve the different desired speeds on the track, and plans the trip accordingly.

However, at times the data found in these databases is not complete, has not been updated, or is simply incorrect or inaccurate. In addition, locomotives may include one or more operating systems that provide for the automated control of certain locomotive functions. Such systems may include fuel savings systems, positive train control systems, brake control systems, and operator coaching systems, which use elements of the track database for the automated control of certain locomotive operations. The manufacturers or vendors of such systems provide relevant components of the track database; however, data conversion, human error, and other factors may lead to incorrect or inaccurate data entry.

In any such case in which the track grade is not correct the train may be traveling too fast on a track, which may result in an accident or inefficient use of fuel; or, the train may be traveling too slow, which may result in the train not meeting a time schedule. Moreover, if for example the data relating to the location of a switch is inaccurate the train may enter the switch at too high a speed, which could cause an accident or derailment.

BRIEF DESCRIPTION OF THE INVENTION

Embodiments of the invention relate to a system for verifying data in a track database, which is used with a track system including a plurality of tracks on which a powered vehicle travels. The system comprises a track profile database stored in a memory and having track profile data relative to one or more track grades and geographic coordinates or range of coordinates associated with each of the one or more track grades. For a designated track or other route over which the vehicle is to travel, a vehicle trip plan is developed, and/or the vehicle is operated, according to the track profile data and a planned vehicle operating condition associated with each of the one or more track grades and the associated coordinates or range of coordinates of the track grades is determined. "Planned vehicle operating condition" refers to a vehicle speed, throttle setting, brake setting, or other parameter according to which the vehicle is to be operated. Thus, for a particular grade at a particular location, the planned vehicle operating condition might be a designated throttle setting or speed.

A data storage device is provided for storing data relative to the geographic coordinates of the vehicle and a current operating condition of the vehicle as the vehicle travels on the track system. In addition, a controller is configured to compare the stored current vehicle operating condition of the vehicle and associated geographic coordinates to the planned vehicle operating condition to verify the accuracy of the track grade data at the associated geographic coordinates.

A method or computer readable media for verifying data in a track database for a track system, on which a powered vehicle may travel, provides a track profile database stored in a memory. The track database contains data relative to one or more track grades of a track and geographic coordinates or range of coordinates associated with each of the one or more track grades. The method or computer readable media also provides a vehicle trip plan developed according to the track profile data that includes a designated path of travel of the vehicle over the track system and a planned vehicle operating condition that is associated with each of the one or more track grades. The method or computer readable media further store data relative to the geographic coordinates of the vehicle and data relative to a current operating condition of the vehicle as the vehicle travels on the track system and compare the stored current vehicle operating condition of the vehicle and associated geographic coordinates to the planned vehicle operation to verify the accuracy of the track grade data at the associated geographic coordinates. The various sections or components of a database that have been verified may be marked accordingly, so one may identify those data points that have not been verified and not unnecessarily repeat the work. In addition, those locations or points that have been determined has not verified or have inaccurate data may be flagged to easily identify the data that must be updated.

BRIEF DESCRIPTION OF THE DRAWINGS

The present invention can be more easily understood and the further advantages and uses thereof more readily apparent, when considered in view of the following detailed description when read in conjunction with the following figures, wherein.

DETAILED DESCRIPTION OF THE INVENTION

Figure 1:
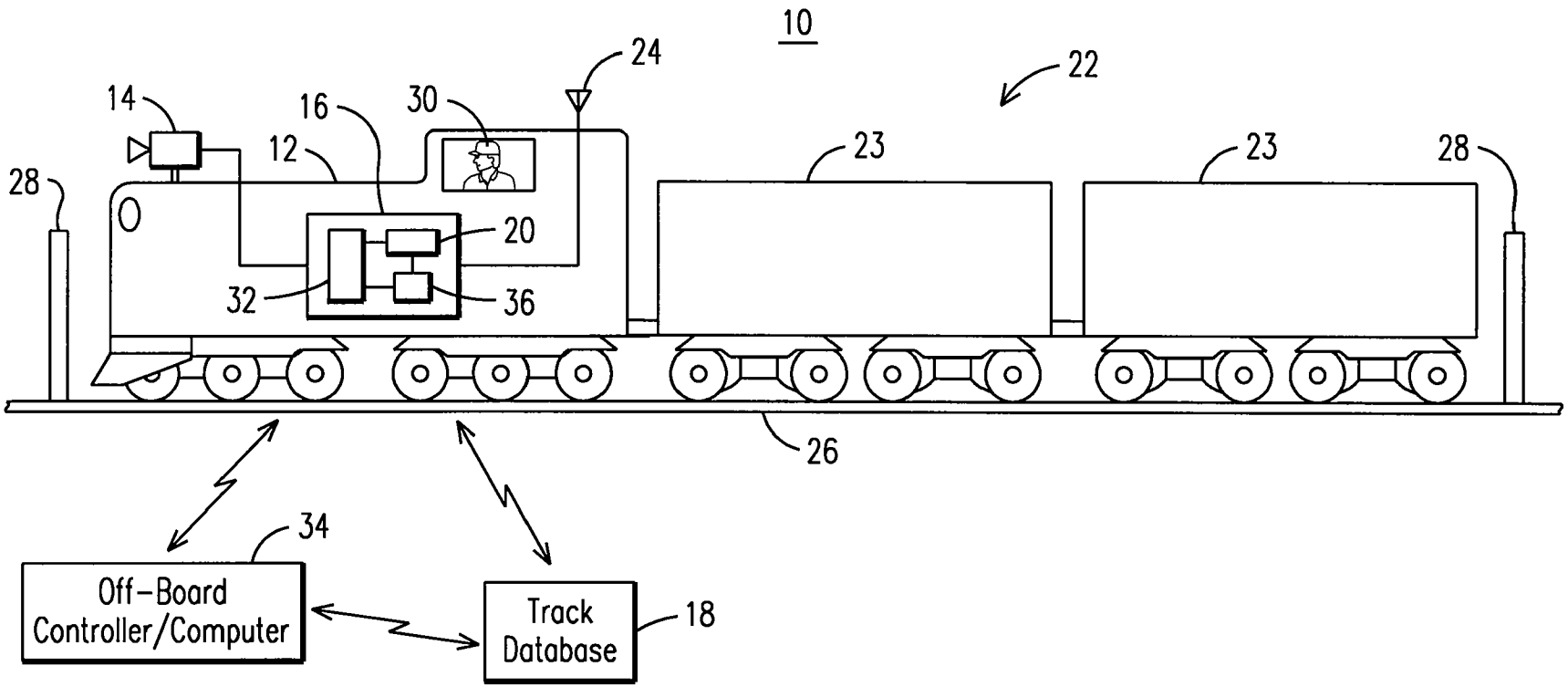
FIG. 1 is a schematic illustration of the data verification system and a locomotive having components of the system.

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained. While the invention is described below in reference to locomotives and trains the invention is not so limited. The invention may used with other vehicles including marine, off-highway vehicles, on-road vehicles, etc. The term "powered vehicle" as used herein shall comprise the vehicles that have an onboard power source sufficient to propel the vehicle and possibly others in a series of vehicles. In the case of trains traveling on railroad tracks, the locomotive is the powered vehicle. The term "track" as used herein shall comprise different pathways, such as off-road, off-highway, roads, marine pathways, or railroad tracks traveled by powered vehicles. In addition, the terms "geographic coordinates" or "coordinates" comprises one or more track locations or locations of a vehicle on a track. The locations may be characterized or determined in any number of ways, including, but not limited to providing longitudinal, latitudinal or elevational coordinates or providing the distance a point or location is from a fixed reference such as a vehicle start or destination location or a mile marker positioned along the track.

Before describing in detail the particular method and apparatus for verifying track database information in accordance with embodiments of the present invention, it should be observed that the present invention resides primarily in a novel combination of hardware and software elements related to said method and apparatus. Accordingly, the hardware and software elements have been represented by conventional elements in the drawings, showing only those specific details that are pertinent to the present invention, so as not to obscure the disclosure with structural details that will be readily apparent to those skilled in the art having the benefit of the description herein.

Figure 2:
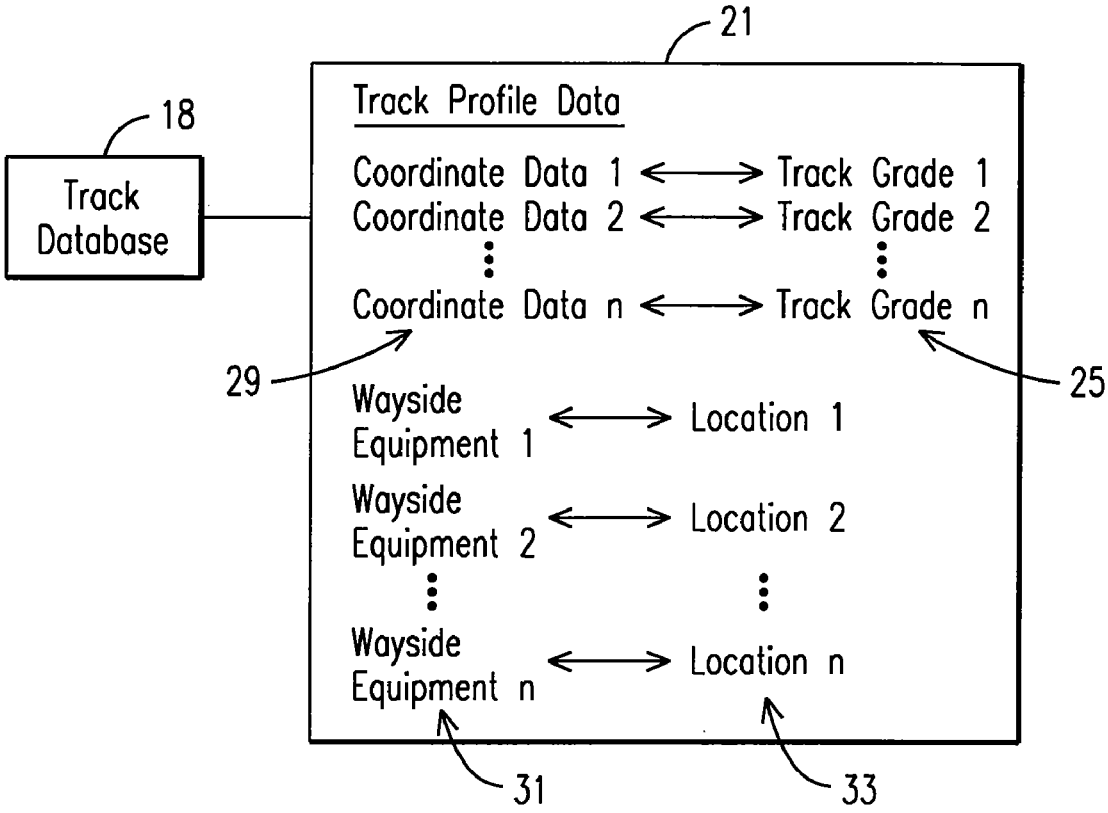
FIG. 2 is a schematic diagram of a track database and relevant data.
Figure 3:
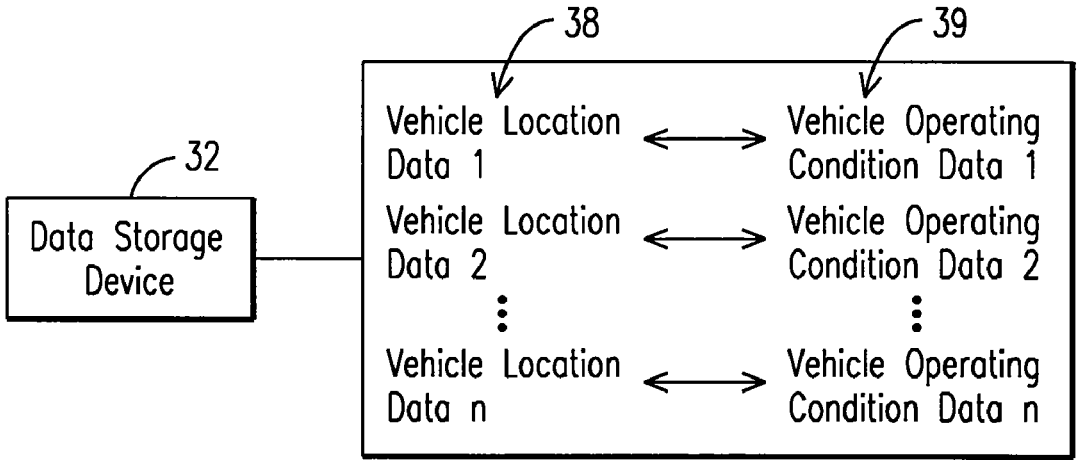
FIG. 3 is a schematic diagram of a data storage device and the relevant data.
Figure 4:
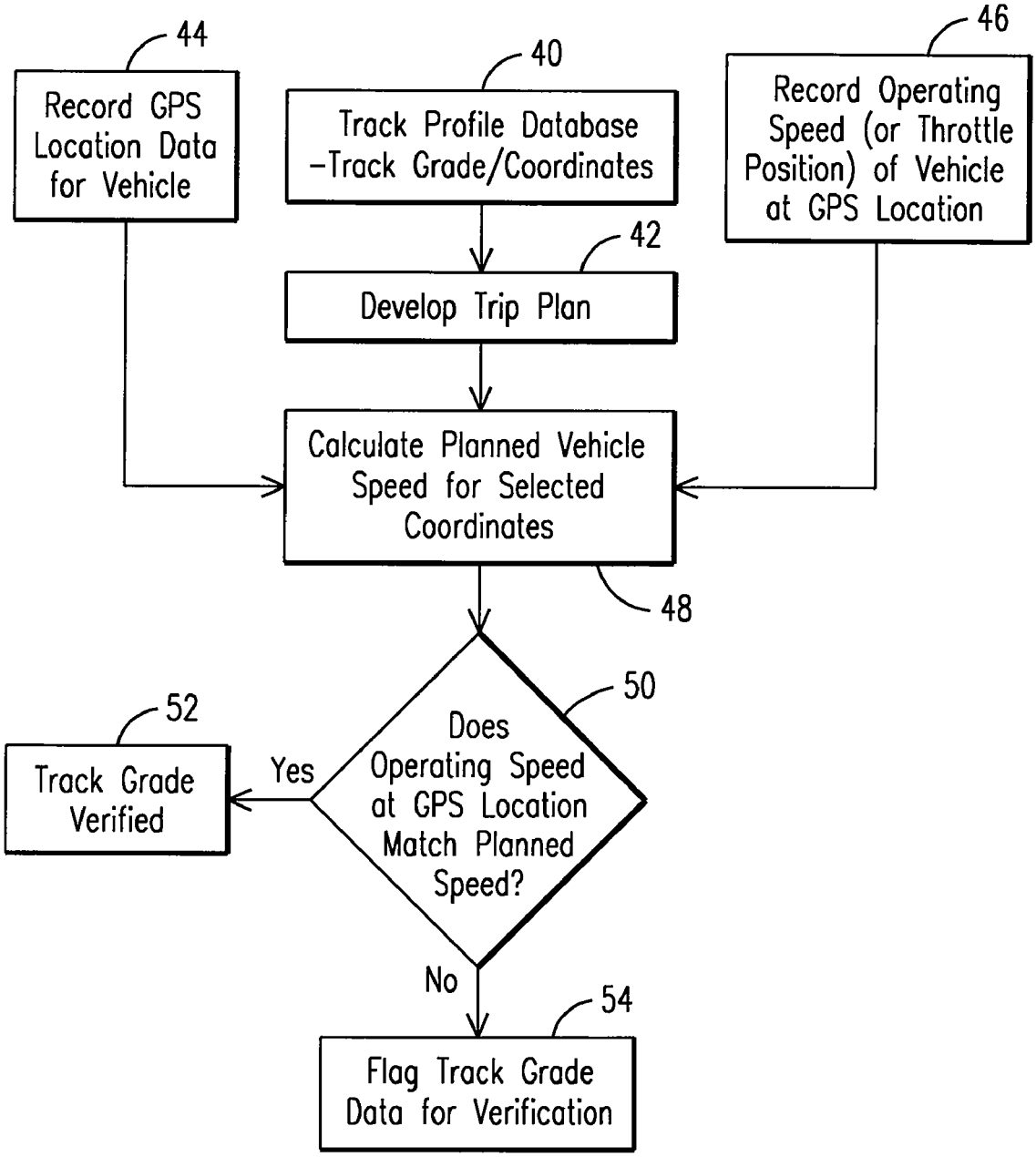
FIG. 4 is a flow chart describing steps in an embodiment of the data verification system and method.

With respect FIGS. 1, 2 and 3, there is schematically illustrated an embodiment of the data verification system 10 used in connection with the operation of a locomotive 12 and train 22 that includes a plurality of railcars 23 and that travel on a track 26. The locomotive 12 includes an onboard operating system 16 that comprises one or more controllers 20 that are used to control locomotive operations or functions. A global positioning system (GPS) transceiver 24 is provided and transmits data relative to the movement and location of the locomotive 12 to the one or more controllers 20 as the locomotive 12 and train are traveling on the track 26. Alternatively, a controller/processor 36 may be provided and programmed to determine the geographic coordinates by estimating or determining the distance the locomotive 12 has traveled on the track 26 from a fixed reference point such as a wayside device, or a starting location of the locomotive 12. Accordingly, coordinate data may be expressed as a distance that is measured, estimated or inferred by the controller 36 that the locomotive 12 has traveled relative to a known object such as a wayside device, or a starting location of the locomotive 12. Alternatively, the controller may determine the location of the locomotive 12 or train 22 based on a collection of inputs such as GPS, speed sensors, operator inputs or wayside sources, etc.

The track 26 represents a section of railroad track that is a component of a track system that may include thousands of miles or tracks that may be divided into one or more geographic subdivisions. A track database 18 having stored track profile data 21 is provided for planning a trip or route on the track 26. The track profile data 21 comprises data relative to the grade 25 of the track 26 at a plurality of geographic coordinates or locations 29 along the length of the track 26. The coordinate data 29 may be absolute geographic data, such as longitudinal and latitudinal data. Such data 29 may also include track elevation data. The track coordinate data may also be provided as a relative distance or a distance range of a selected location of the track is or has traveled from a fixed reference point. The track grade data 25 and corresponding coordinate data 29 may be provided at any selected increments such as fractions of a mile along the track 26. When the track grade remains constant or fixed, within a predetermined range over an extended distance, the track grade data may be provided for fewer track locations. In addition, the track grade data may be provided at various points of interest along the track including locations where the power settings of the locomotive 12 may be changed due to track grade (other factors such as the weight of the train 22 and a desired speed determined according to a trip plan), or at points where the train may enter or exit the track 26. The track grade data 25 may be provided in the form of a percentage value denoting the rate of change of a rise over a designated length of the track, or track elevation data may be provided and with the controller 36 being configured to estimate the grade as the locomotive 12 travels on the track 26.

Data 21, other than track grade data, may be provided in the track database 18. Other such data may comprise speed limits or restrictions for various sections or segments along the track. The speed restrictions may include speed limits imposed by railroad companies and/or local communities (i.e., civil speed limits) or temporary restrictions that are the result of some event, such as track repair, occurring on the track 26. Other physical characteristics, such as track curvature and/or super elevation associated with the track 26 and the location of the curvatures and/or super elevations, may be included in the database. In addition, the identity and location of wayside traffic control devices such as switches, mileposts, grade crossings, and signal lights may be provided. In addition, there may be other items of interest like wayside detectors, dragging equipment, lubrication equipment, wheel temperatures, etc.

The track database 18 (or components of the track database 18) and a train manifest are provided to a train operator who develops a trip plan, and/or operates the train, according to the data 21 in the track database and the train manifest. More specifically, the train operator has been trained and/or follows operating manuals to determine the throttle settings and/or braking commands (or other vehicle operating conditions) for the locomotive 12 traveling on various sections of the track 26. The train operator primarily considers the track grade, speed restrictions, signal information, and train weight and length to determine the different throttle positions (or locomotive speed or other vehicle operating conditions) for the locomotive during a trip. In addition, the train operator 30 may also verify that one or more controllers 20 have the same data found in the track database 18 and the train manifest.

With respect to FIG. 3, in steps 40 and 42 respectively, the track database 18 is provided and the train operator 30 develops a trip plan for the locomotive 12 and train 22. As the train 22 is traveling on track 26, the GPS transceiver 24 transmits data 38 relative to the location of the locomotive 22 on the track 16 to a data storage device 32. In addition, the controller 20 transmits data 39 relative to the speed, power and braking at which the locomotive 12 is traveling on the track to the data storage device 32. Accordingly, the data storage device 32 has stored data relative to the speed at which the locomotive 12 has traveled on the track 26 at various locations on the track 26. In addition, data from a train manifest relating to the physical parameters or characteristics of the train such as its length, weight, etc. may also be considered in determining the speed at which the locomotive 12 should travel on the track 26. This information or data can then be used to verify whether the track grade data in the track database 18 is accurate.

In step 48, using the track grade data 25, the associated notch settings for the different sections of the track 16, and known algorithms, it is possible to calculate a planned speed or other vehicle operating condition for the locomotive 12 to travel on the track 26 according to the trip plan developed by the operator. In addition, other information such has train manifest (weight), desired throttle setting etc. may be considered to calculating the planned speed. In step 50, the recorded operating speed of locomotive 12 is then compared to the planned speed at various sections or points on the track 26 to see if the data matches or is within an acceptable range or within a required accuracy. If the operating speed and planned speed data matches, then the track grade data for a selected section or point of the track 26 in the database 18 may be marked as verified, as at step 52. If the data does not match, then in step 54 the identified location or section of the track 16 and the associated track grade data is flagged for further investigation into the reason for the discrepancy. As noted above, the discrepancy may be due to incorrect track grade data entered in the database 18.

The verification processing may be conducted on an off-board controller 34, shown in FIG. 1. When the train 22 has completed a trip, a portion of a trip, or has otherwise stopped at a station with an off-board controller 34, the data in the data storage device 32 may be downloaded to the off-board controller 34 for verifying the track grade data. The controller 34 is provided with the track database 18 for processing the verification steps. In addition, or alternatively, operating system 16 may include the controller/processor 36 that is programmed to calculate or access the planned speeds for various locations of the track 26 and compare the operating speed to the planned speed for real time verification. The operating system 16 may include a display screen (not shown) that displays the track grade data provided in the track database 18 and an estimated track grade determined by the controller/processor 36 based on the current operating speed or throttle position of the locomotive 12. Note, data from multiple trains or locomotives may be provided to the controller 34 to further verify the accuracy of the track grade data. Using multiple locomotives as multiple reference points can eliminate or help identify bad data or incorrect data relative to a controller's 36 estimation of the track grade.

Again with respect to FIG. 1, the data verification system may also include a camera 14 mounted on the locomotive 12 for recording images of wayside equipment 28 such as mile markers, switches, grade crossings, operator instructions, light signals, speed limit signs, dragging equipment detectors, lubrication equipment, wheel temperature detectors, etc. The camera 14 may be configured to collect visible spectral data of the wayside equipment 28 as the locomotive 12 travels on the railroad track 26. The camera 14 may be a video camera that runs continuously or that is configured to run periodically at estimated times when the locomotive 12 passes the wayside equipment 12. The camera 14 is linked to the operating system 16 of the locomotive 12 to transmit recorded images to the data storage device 32. The camera 14 may be configured to record date and time information relative to the recorded images. In addition, the GPS transceiver 24, or other location determining equipment, transmits the locomotive 12 coordinate data to the data storage device 32, which data may include date and time information. Alternatively, or in addition, the operating system 16 may be configured to record date and time information as the recorded image and GPS coordinate data is received at the operating system 16. In addition, the operation system 16 may be configured to determine the location of the locomotive 12 in terms of distance the locomotive has travelled and record the data for some predetermined distance intervals, and associate those distances with dates and time, so that a recorded image may be associated with a location of the locomotive 12. In this manner, the recorded image may be matched with the appropriate coordinate data based on the date and time information provided by the camera 14 and the GPS transceiver 24. As described above, other methods of determining location of the locomotive 12 on the track 26 may be utilized. For example, the controller 36 may be configured to estimate a distance the locomotive 12 has traveled relative to a fixed reference point such as a starting point or a wayside device 28.

Figure 5:
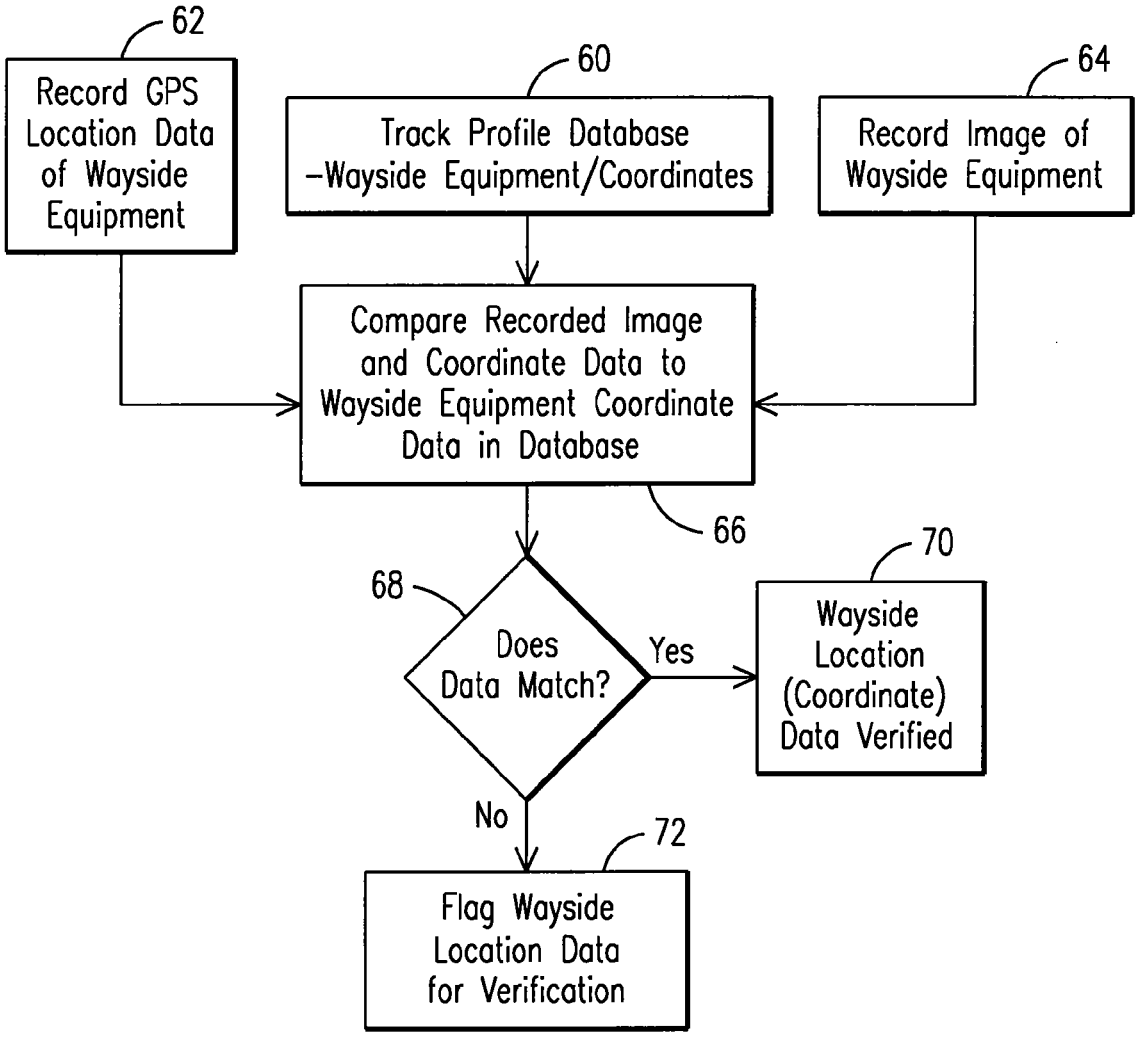
FIG. 5 is a flow chart describing steps of a second embodiment of the data verification system and method.

With respect to FIG. 5, the track database 18 is provided in step 60 and includes track profile data 21 relative to the identity 31 and location 33 of various wayside devices 28 positioned along the track 26. In steps 62 and 64 respectively, GPS coordinate data relative to the location of the locomotive 12 and one or more images of the wayside equipment 28 is recorded and stored in the data storage device 32. As described above, in lieu of the transceiver 24, the controller/processor 36 or other controllers 20 may determine the location of the locomotive 12 by calculating the distance the locomotive has traveled relative to some fixed reference point, when the image is received at the data storage device 32 from the camera 14.

In step 66, the wayside equipment coordinate data is compared to the corresponding data 33 stored in the track database 18; and, in steps 68 and 70 if the coordinate data matches, the wayside signal 28 and coordinate data are marked as verified. In steps 68 and step 72, if the recorded coordinate data for the wayside equipment 28 does not match, the wayside equipment coordinate data 33 in the track database 18 is flagged for further verification or investigation. As described above, the verification processing may be conducted using an off-board controller 34 or the onboard controller/processor 32 for real time verification. Verifying the location of the wayside equipment is critical to the operation of the locomotive 12 and train 22. The operator 30 makes decisions relative to the speed of the locomotive 12 based on the location of certain wayside equipment 28. For example, if data is provided that signal lights are located five miles ahead of the locomotive 12, and there is a speed restriction associated with signal lights, the operator 30 may need to start decelerating and slowing the locomotive within two miles of the lights in order to see and interpret the signals accordingly.

Processing the data may be conducted by the wayside controller 34 or the operating system 16 may be configured to process the data during the normal operation of the train. When a locomotive 12 completes a trip, or otherwise stops on a track 26, image data stored either in the camera 14 or in the operating system 16 may be loaded to a wayside controller 36. In addition, data relative to the geographic coordinates for the wayside devices depicted in the images is provided. In an embodiment, multiple trains may be used wherein each train may be assigned designated track sections so that multiple trains may more record images for an entire railroad track system. As described above the database may be updated by marking data relative to the location and identity of wayside devices 28 as verified. Data relative to entire track sections may also be marked. In addition, the wayside devices 28 that are not accurately represented in the database may be flagged so that an operator can update the database accordingly. As discussed above the onboard controller 36 may be configured to comprise a location determiner algorithm by using data from various inputs such as the GPS transceiver, speed sensors, operator inputs or wayside sources. The controller 36 may also receive the image data or coordinate data, and compare the determined location for grade or wayside equipment to verify the accuracy of the database within in some predetermined range.

Embodiments described above may be implemented on a suitable computer system, controller, data, or generally a computer readable medium. For example, the steps of the methods described above may correspond to computer instructions, logic, software code, or other computer modules disposed on the computer readable medium, e.g., floppy disc, hard drive, ASIC, remote storage, optical disc, or the like. The computer-implemented methods and/or computer code may be programmed into an electronic control unit of an engine, a main control system of the locomotive, a remote control station that communicates with the locomotive unit, or the like, as described above.

An embodiment of the present invention relates to a computer readable memory medium for verifying data in a track database for a track system on which a powered vehicle may travel. The computer readable memory medium includes a computer module for providing a track profile database stored in a memory. The database includes track profile data relative to one or more track grades of a track and geographic coordinates or range of coordinates associated with each of the one or more track grades of the track. (That is, for each track grade, there are geographic coordinates or a range of coordinates associated therewith.) The computer readable memory medium also includes a computer module for operating the powered vehicle along a designated path of travel of the vehicle over the track system. The vehicle is operated according to the track profile data and following a planned vehicle operating condition that is associated with each of the one or more track grades. (That is, for each track grade, there is a planned vehicle operating condition associated therewith.) The computer readable memory medium also includes a computer module for storing data relative to the geographic coordinates of the vehicle and data relative to a current operating condition of the vehicle as the vehicle travels on the track system. The computer readable memory medium also includes a computer module for comparing the stored current vehicle operating condition of the vehicle and associated geographic coordinates to the planned vehicle operation to verify the accuracy of the track grade data at the associated geographic coordinates. The verified track grade data is optionally marked as accurate or inaccurate.

In another embodiment, the planned vehicle operating condition is a planned speed of the vehicle, and the current operating condition of the vehicle is a current speed of the vehicle. In this manner, the current operating speed is compared to the planned operating speed to verify the accuracy of the track grade data.

In another embodiment, the track profile data includes data relative to one or more vehicle speed restrictions associated with one or more sections of the track.

In another embodiment, the computer readable memory medium includes a computer module for transmitting the vehicle coordinate data from a global positioning system transceiver on the vehicle to the data storage device.

In another embodiment, in the computer readable memory medium, the computer module for storing the vehicle coordinate data is a computer module that includes code or programming instructions, that when executed by the controller, cause the controller to determine a distance the vehicle has traveled on the track from a fixed reference point.

In another embodiment, the computer readable memory medium includes a computer module for providing track profile data that includes data relative to an identity of one or more wayside devices and geographic location data for each wayside device, and a computer module for recording images of wayside devices as the powered vehicle travels on the track. The computer readable memory medium may also include a computer module for recording the geographic location of the camera at different intervals on the track, where each geographic location of the camera represents the location of a wayside device an image of which was recorded on the camera.

Although embodiments of the invention have been described herein primarily in regards to locomotives, trains, and tracks, the invention more generally relates to vehicles traveling over a designated route. For example, one embodiment of the present invention relates to a system for verifying data in a database relating to a route on which a powered vehicle may travel. In this embodiment, the system includes a route profile database stored in a memory. The route profile database includes route profile data relating to one or more route grades of the route (e.g., rate of change of an elevation rise or fall over a designated length of the route) and, for each route grade, a location associated with the route grade. (The location may be a particular point, or a segment along the route.) The powered vehicle is operated over the route according to the route profile data and, for each route grade, a planned vehicle operating condition associated with the route grade. (For example, for a given route grade at a location, the planned vehicle operating condition might be a throttle setting at which the vehicle is to be operated when it reaches the location.) The system also includes data storage device for storing data relative to the location of the vehicle and, for each location, data relative to a current operating condition of the vehicle at the location, as the vehicle travels on the route. (For example, at a first location of the vehicle, data relating to a current operating condition of the vehicle at the first location is stored; at a second location of the vehicle, data relating to the current operating condition of the vehicle at the second location is stored; and so on.) The current operating condition might be vehicle speed, for example. The system also includes a controller configured to compare the stored current vehicle operating condition of the vehicle and associated location to the planned vehicle operating condition to verify the accuracy of the route grade data at the associated location. Post processing of the track grade data and location of wayside equipment may be conducted quickly and efficiently by using multiple powered vehicles. For example, each powered vehicle may be assigned sections of a track and the stored data may be fast forward to more quickly locate the wayside equipment associated with a track section.

While various embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

The invention claimed is:

1. A system comprising:

a track profile database stored in a memory, the database having track profile data relative to one or more track grades of a track on which a powered vehicle travels and designated geographic locations associated with locations of the one or more track grades and wherein the track profile data further includes an identity of one or more wayside devices and designated geographic locations of the one or more wayside devices;

wherein the powered vehicle is operated over the track according to one or more planned vehicle operating conditions that are determined based on the one or more track grades;

a data storage device for storing one or more current operating conditions of the powered vehicle at the designated geographic locations associated with the one or more track grades as the powered vehicle travels on the track;

a controller configured to verify an accuracy of the track profile data at the designated geographic locations associated with the one or more track grades by comparing the one or more current operating conditions of the powered vehicle to the one or more planned operating conditions for the powered vehicle at the designated geographic locations; and a camera configured to obtain images of the one or more wayside devices as the powered vehicle travels on the track.

2. The system of claim 1, wherein the one or more planned operating conditions include a planned speed of the powered vehicle and the one or more current operating conditions include a current actual speed of the powered vehicle, and wherein the controller is configured to verify the accuracy of the track profile data by comparing the current actual speed of the powered vehicle to the planned speed of the powered vehicle.

3. The system of claim 1, wherein the track profile database further comprises one or more speed restrictions associated with one or more of the designated geographic locations.

4. The system of claim 1, further comprising a global positioning system transceiver configured to be disposed onboard the powered vehicle and to transmit vehicle location data to the data storage device.

5. The system of claim 1, wherein the powered vehicle is a locomotive that is configured to travel on a railroad track system and the controller is configured to be disposed onboard the locomotive.

6. The system of claim 1, wherein the controller is configured to determine an actual location of the powered vehicle relative to one or more of the designated geographic locations based on a distance that the powered vehicle has traveled on the track from a reference point.

7. The system of claim 1, wherein the controller is configured to mark the track profile data in the track profile database that has not been verified as accurate.

8. The system of claim 1, wherein the controller is configured to verify an accuracy of the designated geographic locations of the one or more wayside devices by directing the camera to obtain the images when the powered vehicle is disposed at the designated geographic locations of the one or more wayside devices.

9. A method comprising:

providing a track profile database stored in a memory, the database having track profile data relative to one or more track grades of a track on which a powered vehicle travels and designated geographic locations associated with locations of the one or more track grades and wherein the track profile data includes an identity of one or more wayside devices and designated geographic locations of the one or more wayside devices;

monitoring one or more current operating conditions of the powered vehicle at the designated geographic locations associated with the one or more track grades as the vehicle travels on the track according to one or more planned operating conditions that are determined based on the one or more track grades;

obtaining images of the one or more wayside devices as the powered vehicle travels on the track; and verifying an accuracy of the track profile data at the geographic locations associated with the one or more track grades by comparing the one or more current operating conditions of the powered vehicle to the planned operating conditions of the powered vehicle at the designated geographic locations.

10. The method of claim 9, wherein the one or more planned operating conditions of the powered vehicle include a planned speed of the powered vehicle and monitoring the one or more current operating conditions of the powered vehicle comprises monitoring a current actual speed of the powered vehicle, further wherein verifying the accuracy of the track profile data includes comparing the current actual speed to the planned operating speed.

11. The method of claim 9, wherein the track profile database includes one or more speed restrictions associated with one or more of the designated geographic locations.

12. The method of claim 9, further comprising transmitting vehicle location data from a global positioning system transceiver disposed onboard the powered vehicle to the data storage device.

13. The method of claim 9, wherein the powered vehicle is a locomotive that travels on a railroad track system and verifying the accuracy of the track profile data is performed onboard the powered vehicle.

14. The method of claim 9, wherein monitoring the one or more current operating conditions of the powered vehicle includes determining an actual location of the powered vehicle relative to one or more of the designated geographic locations based on a distance that the powered vehicle has traveled on the track from a reference point.

15. The method of claim 9, further comprising marking the track profile data in the track profile database that has not been verified as accurate.

16. The method of claim 9, further comprising verifying an accuracy of the designated geographic locations of the one or more wayside devices based on the images of the one or more wayside devices that are obtained when the powered vehicle is at the designated locations of the one or more wayside devices.

17. A system comprising:

a route profile database stored in a memory, the database having route profile data relating to one or more route grades of a route on which a powered vehicle travels and one or more designated locations associated with the one or more route grades and wherein the track profile data includes an identity of one or more wayside devices and designated geographic locations of the one or more wayside devices;

wherein the powered vehicle is operated over the route according to one or more planned vehicle operating conditions that are based on the one or more route grades;

a data storage device for storing one or more current operating conditions of the powered vehicle at the one or more designated locations associated with the one or more route grades as the powered vehicle travels on the route;

a controller configured to verify an accuracy of the route profile data by comparing the one or more current operating conditions of the powered vehicle to the one or more planned operating conditions at the one or more designated locations; and a camera configured to obtain images of the one or more wayside devices as the powered vehicle travels on the track.

18. A method comprising:

monitoring one or more current operating conditions of a powered vehicle traveling along a route at one or more designated locations associated with one or more previously designated grades of the route, the powered vehicle traveling along the route according to one or more planned operating conditions that are based on the one or more previously designated route grades; and verifying an accuracy of one or more previously designated route grades by comparing the one or more current operating conditions of the powered vehicle to the one or more planned operating conditions at the one or more designated locations;

wherein the one or more planned operating conditions include a planned speed of the powered vehicle and the one or more current operating conditions include a current actual speed of the powered vehicle, and wherein verifying the accuracy includes comparing the current actual speed of the powered vehicle to the planned speed of the powered vehicle.

* * * * *